US008721382B2

(12) United States Patent
Maidana Otero

(10) Patent No.: US 8,721,382 B2
(45) Date of Patent: May 13, 2014

(54) REUSABLE PIÑATA

(76) Inventor: Miguel Angel Maidana Otero, Sani Pere de Ribes (ES)

( * ) Notice: Subject to any disclaimer, the term of this patent is extended or adjusted under 35 U.S.C. 154(b) by 150 days.

(21) Appl. No.: 13/486,108

(22) Filed: Jun. 1, 2012

(65) Prior Publication Data

US 2013/0323999 A1 Dec. 5, 2013

(51) Int. Cl.
*A63H 33/00* (2006.01)

(52) U.S. Cl.
USPC ..... 446/5

(58) Field of Classification Search
USPC ..... 446/5, 308–312, 475, 486; 229/116.1; 273/108, 317
See application file for complete search history.

(56) References Cited

U.S. PATENT DOCUMENTS 5,242,308 A * 9/1993 Estrada ..... 434/365
5,263,889 A * 11/1993 Ledonne ..... 446/5
6,354,904 B1 * 3/2002 Grey et al. ..... 446/5
6,978,974 B1 * 12/2005 Marasco ..... 248/124.1
7,442,106 B1 * 10/2008 Menow et al. ..... 446/5
2007/0099534 A1 * 5/2007 Alas ..... 446/5
2007/0298647 A1 * 12/2007 Lee et al. ..... 439/354
2013/0092138 A1 * 4/2013 Aguila ..... 124/16

* cited by examiner

*Primary Examiner* — Kurt Fernstrom
(74) *Attorney, Agent, or Firm* — Porzio, Bromberg & Newman, P.C.

(57) ABSTRACT

A reusable piñata including a first container intended to contain gifts to be given, the first container being provided with a top filling mouth and a horizontal axis for its hanging and knocking down. A second container able of vertical displacement and provided with a upper mouth for introducing inside this various elements by participants or players, in order to cause the descent of the second container. An actuating cord can be mounted on support elements and describing an inverted U-like general path. One of the ends of the cord being externally fixed to the bottom of the first container and on top to the second container for its hanging fastening and causing during the descent of the second container a dump of the first container and the fall of the gifts contained therein.

9 Claims, 2 Drawing Sheets

REUSABLE PIÑATA

BACKGROUND OF THE INVENTION

1. Field of the Invention

The present invention relates to a reusable piñata, of the type comprising a container containing objects or gifts to be given.

2. Description of Related Art

The piñatas used in children's games and comprising a container hung on a high point and containing various objects, such as toys, gifts or candy, which fall to the floor when the player achieves a determined objective, are currently widely known.

The container of the piñata can be made of various materials, such as clay or paper, and have shapes of animals, star or any other; in any case when this is hit, it is achieved its breaking or opening, falling to the floor its content.

Generally in this game, the breaking of the piñata occurs, which avoids that it can be reused.

They are also known some reusable piñats, such as that described in the utility model ES 1067099U, in which the container containing the gifts has a prismatic shape, closed below by an inflatable balloon which when it is broken allows the fall of objects contained in the above-mentioned container. In this case the piñata can be reused by coupling in its bottom mouth a new closing balloon.

In other known piñatas the container has a bottom download trapdoor which when it is actuated, either by hitting or pulling a cord or strip, it opens allowing the fall of the content.

In all the aforementioned background, the children act directly on the structure or container containing gifts, often attaining their total destruction due to the excitement of the game and resulting nonviable its reuse.

SUMMARY OF THE INVENTION

The reusable piñata of this invention has, as usual, a container containing the objects or gifts to be given, having however a series of constructive peculiarities intended to allow that the intervention of the participants not be directly on said container, but on a second container which can be hidden and more or less distant from the container containing the gifts, which causes a greater surprise to participants when the gifts at one point do not fall directly on them, but in a more or less far point. On the other hand, the intervention of the participants on this second container does not envisage the hitting of the same, but the introduction inside this of various objects, so that when the second container reaches a certain weight, causes the fall of the gifts contained in the first container.

As it has just been mentioned and according to the invention, this piñata comprises:-a first container (1), which contains the gifts to be given, provided with a top filling mouth and a horizontal axis for its hanging and dumping, moved towards its top;-a second container able of vertical displacement and provided with a top mouth for introducing inside this various elements by participants or players, in order to cause the descent of the second container, and, -an actuating cord mounted on support elements and describing an inverted U-like general path, one of the ends of the cord being externally fixed to the bottom of the first container and on top to the second container for its hanging fastening, causing said cord, during the descent of the second container and due to the weight of the objects introduced in said second container, the dump of the first container and the fall of the gifts contained therein.

In a first embodiment of the invention the first and the second container are housed in a box or common casing which has a vertical separator that defines two differentiated compartments for the accommodation of the first and second containers.

In this embodiment the rotation axis of the first container is mounted on the side walls of the corresponding compartment, or first compartments, and the second container is mounted with the possibility of vertical displacement in the second compartment of the box.

The first compartment has a top opening for the placement of the gifts in the first container and a bottom opening for the fall of said gifts when the dump of the first container occurs, while the second compartment has a top, vertical, or side mouth through which the participants must introduce the objects which will cause, when they reach a certain weight, the descent of the second container, with the subsequent dump of the first container and the fall of the gifts.

In this embodiment, the cord that binds together the two containers passes by the top of the outer box and relies on guiding elements that can be dealt in a specific embodiment of pulleys or of the intermediate separator itself.

In a second embodiment the piñata comprises means for the hanging of the first container through its axis, said first container being laterally spaced in greater or lesser extent of the second container and only bound together to the second container by the actuating cord. In this second embodiment the piñata also has means suitable for the guiding of the actuating cord in the direction of dump of the first container.

BRIEF DESCRIPTION OF THE DRAWINGS

In order to supplement the description that is being carried out and in order to facilitate the understanding of the features of the invention, the present specification is accompanied by a set of drawings in which, with illustrative and non-limitative character, it has been represented the following.

DETAILED DESCRIPTION

Figure 1:
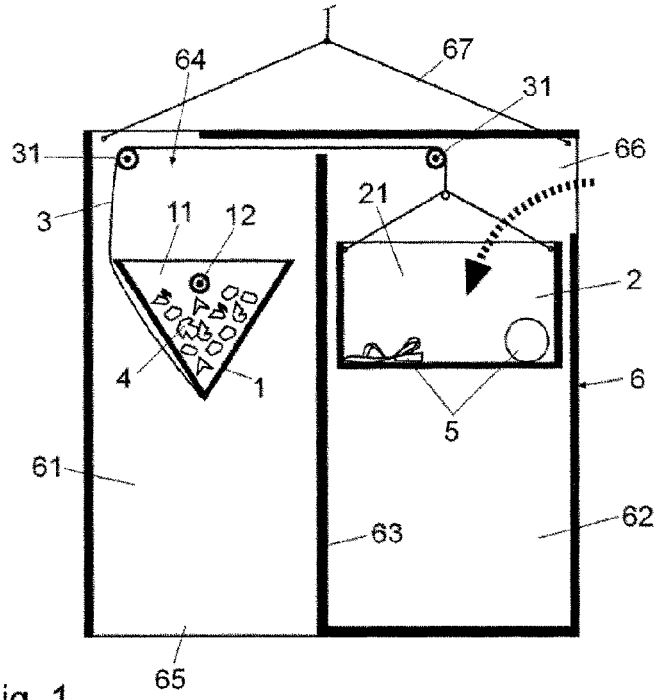
FIG. 1 shows an elevation view of an embodiment of the reusable piñata of the invention divided by a vertical plane during its use, and in which the first and second containers are arranged inside a box or casing.

Reference will now be made in greater detail to a preferred embodiment of the invention, an example of which is illustrated in the accompanying drawings. Wherever possible, the same reference numerals will be used throughout the drawings and the description to refer to the same or like parts.

As it can be seen in the embodiments of the accompanying Figures, the reusable piñata comprises: a first container (1) intended to contain the gifts (4) to be given, said first container being provided with a top mouth (11) and a horizontal axis (12) for its hanging and knocking down; a second container (2) able of vertical displacement and provided with a top mouth (21) for introducing inside this various elements (5) such as balls, shoes, or anything else; an actuating cord (3) mounted on support elements (31) and describing an inverted U-like general path, one of the ends of the cord being externally fixed to the bottom of the first container (1) and on top to the second container (2) for its hanging fastening.

Figure 2:
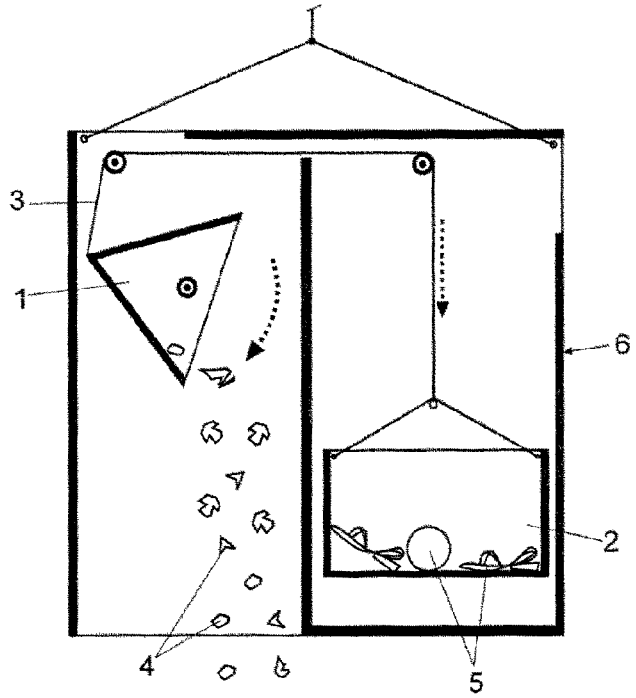
FIG. 2 shows a view similar to the previous one during the descent of the second container, causing the dump of the first container and the fall of the gifts contained in the same.
Figure 3:
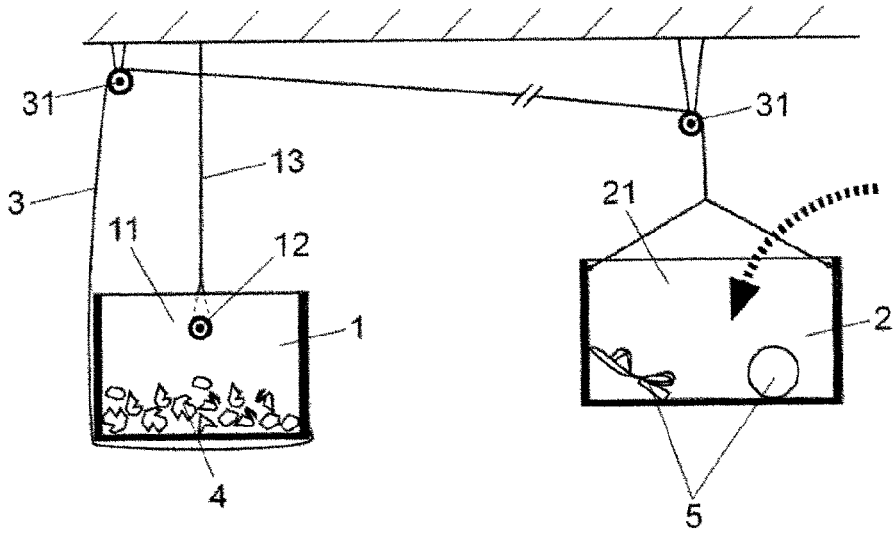
FIG. 3 shows a variant of embodiment of the piñata without the outer box, laterally spaced and in which the first and the second container are only bound together by the actuating cord, the piñata has being represented in an initial use position.
Figure 4:
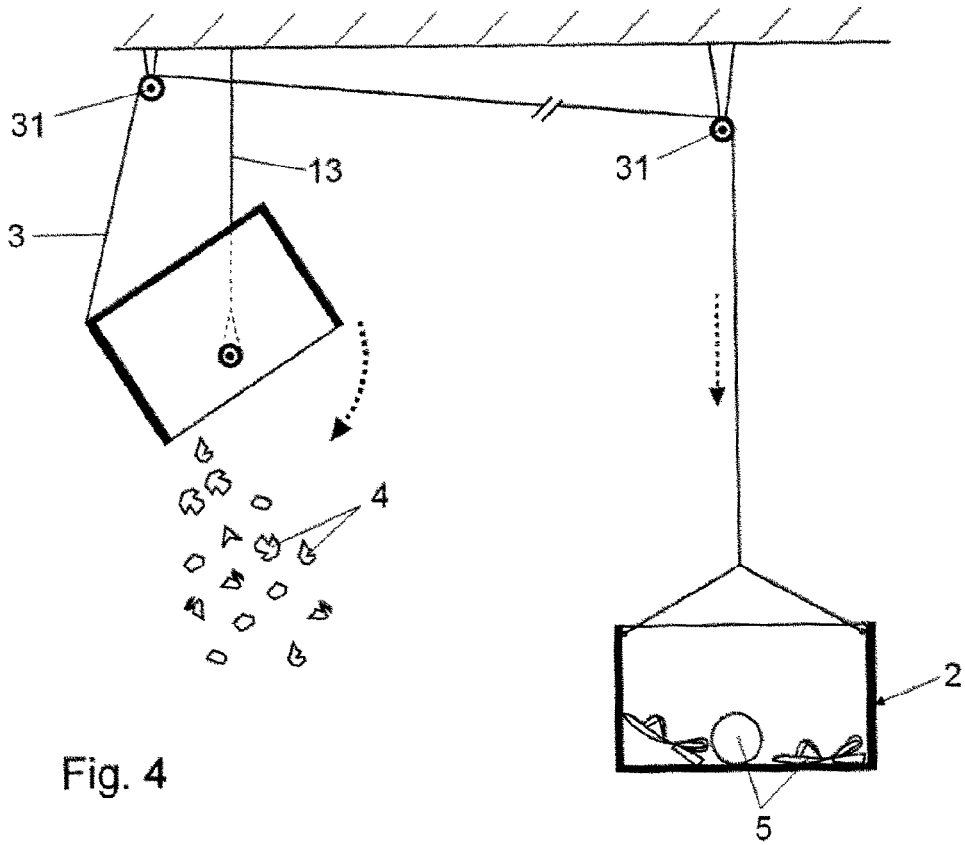
FIG. 4 shows a view similar to the previous one during the dump of the first container and the fall of the gifts contained in the same.

The horizontal axis (12) is displaced towards the top of the first container ensuring its holding in a vertical rest position, represented in FIGS. 1 and 3, when the second container (2) is empty or when objects (5) introduced therein do not reach a sufficient weight to cause the descent of the second container (2), the dump of the first container (1) and the fall of gifts (5) contained in the first container (1), as shown in FIGS. 2 and 4.

It is noteworthy that the support elements (31) of the actuating cord (3) can be pulleys, ropes, beams, tree branches, or any other object enabling the support and sliding of the cord on said support elements.

With the basic configuration described, the containers (1, and 2) can be housed in a common outer box (6), as shown in the embodiment shown in FIGS. 1 and 2, or be spaced in a greater extent and only bound together by means of the actuating cord (3) as shown in the variant of embodiment shown in FIGS. 3 and 4.

In FIGS. 1 and 2, the box (6) comprises two vertical compartments (61, 62), differentiated by an intermediate separator (63), for the accommodation of the first container (1) and the second container (2) respectively.

The compartment (61) has a top mouth (64) for introducing the gifts (4) in the first container, and a bottom mouth (65) for the fall of the gifts (4) when the dump of the first container occurs.

The compartment (62) in turn has on top a side mouth (66) through which the participants must introduce the objects (5) which cause due to its own weight the descent of the second container (2) and the dump of the first container (1).

This box (6) has on top some cords (67) for its hanging at greater or lesser height, varying the difficulty for introducing or "scoring a basket" the objects (5) through the side mouth (66).

In this embodiment the opposite ends of the horizontal axis (12) are mounted on the opposite side walls of the box (6).

In the example shown in FIGS. 3 and 4, the first container is hung from the ceiling by a cord (13) which is fixed to the ends of the axis (12).

Once sufficiently described the nature of the invention, as well as a preferred embodiment, it is put on record for the appropriate effects that the materials, shape, size and arrangement of the elements described above may be modified, provided this does not involve any alteration of the essential characteristics of the invention that are claimed below.

What is claimed is:

1. A reusable piñata, comprising:

a first container intended to contain the gifts to be given, said first container being provided with a top filling mouth and a horizontal axis for its hanging and knocking down;

a second container able of vertical displacement and provided with a upper mouth for introducing inside this various elements by participants or players, in order to cause the descent of the second container, and, an actuating cord mounted on support elements and describing an inverted U-like general path, one of the ends of the cord being externally fixed to the bottom of the first container and on top to the second container for its hanging fastening, causing said cord during the descent of the second container, the dump of the first container and the fall of the gifts contained therein.

2. The reusable piñata, according to claim 1, wherein the horizontal axis is displaced towards the top of the first container for its holding due to its own weight in a vertical rest position.

3. The reusable piñata, according to claim 1 wherein the first container and the second container are arranged inside a common outer box comprising two vertical compartments, differentiated by an intermediate separator, for the accommodation of the first container and the second container respectively.

4. The reusable piñata, according to claim 3, wherein the compartment which contains the first container has a top mouth for introducing the gifts in said first container and a bottom mouth) for the fall of the gifts during the dump of the first container.

5. The reusable piñata, according to claim 3, wherein the compartment which contains the second container has on top a side mouth for introducing objects in said second container.

6. The reusable piñata, according to claim 3, wherein the box has on top some cords for its hanging at greater or lesser height.

7. The reusable piñata, according to claim 3, wherein the opposite ends of the horizontal axis of the first container are mounted on the opposite side walls of the box.

8. The reusable piñata, according to claim 1, wherein the first container and the second container are laterally spaced and bound together only by the actuating cord.

9. The reusable piñata, according to claim 8, wherein the first container comprises a cord for its hanging by the ends of the horizontal axis.

* * * * *